US006023854A

United States Patent [19]

Tsunomoto et al.

[11] Patent Number: 6,023,854

[45] Date of Patent: Feb. 15, 2000

[54] SPIN EXTRACTOR

[75] Inventors: Yoshitaka Tsunomoto, Otsu; Tomohiko Ikeda, Kusatsu; Masafumi Nishino, Kyoto; Kiyonori Tamura, Yokaichi, all of Japan

[73] Assignee: Sanyo Electric Co., Ltd., Osaka, Japan

[21] Appl. No.: 09/116,441

[22] Filed: Jul. 16, 1998

[30] Foreign Application Priority Data

Jul. 23, 1997 [JP] Japan ..... H9-214049

[51] Int. Cl.[7] ..... F26B 13/10

[52] U.S. Cl. ..... 34/531; 34/560; 34/58

[58] Field of Search ..... 34/531, 560, 562, 34/58, 603, 606; 68/12.14, 23.1, 20, 58; 318/431, 433, 438, 483

[56] References Cited

U.S. PATENT DOCUMENTS

| | | | |
|---|---|---|---|
| 3,909,955 | 10/1975 | Janke | 34/531 |
| 4,481,786 | 11/1984 | Bashark | 34/531 X |
| 4,517,695 | 5/1985 | Hoffmann et al. | 68/23.1 X |
| 5,006,778 | 4/1991 | Bashark | 318/431 X |
| 5,692,313 | 12/1997 | Ikeda et al. | 34/58 |

FOREIGN PATENT DOCUMENTS

A-6-254294 9/1994 Japan .

A-9-290089 11/1997 Japan .

*Primary Examiner*—Stephen Gravini
*Attorney, Agent, or Firm*—Oliff & Berridge, PLC

[57] ABSTRACT

The invention relates to a spin extractor for extracting liquid from wet laundry by rotating a drum with the laundry contained therein at high speed about a horizontal axis. In an inventive spin extractor, while an operation controller controls the speed of the drum so that the laundry is slightly pressed on the inner peripheral wall of the drum by centrifugal force and rotates with the drum, a position detector detects the position of an eccentric load due to the laundry as a first position. Then, the speed of the drum is raised to a second speed for weak extraction, which is lower than a predetermined maximum speed for extraction, and the position detector detects the position of the eccentric load as a second position. A quality determiner checks the displacement of the second position from the first position to determine the uniformity in extraction quality of the articles, where the extraction quality of an article represents how easily liquid is extracted therefrom. When the uniformity in the extraction quality is low, the weights of the articles decrease unevenly through the weak extraction, which causes a change in the position of the eccentric load. So, when, the displacement of the position is greater than a preset value, the operation controller sets an extraction speed lower than the maximum speed, and rotates the drum at the extraction speed during the extraction, whereby abnormal vibration is avoided.

12 Claims, 5 Drawing Sheets

DRUM PERIPHERY
(360°)
80

M1

M2
81
80

M1
48°
48°

M2

SPIN EXTRACTOR

The present invention relates to a spin extractor for extracting liquid (such as water or dry cleaning solvent) from the wet laundry by rotating a basket drum with the laundry contained therein at high speed about a horizontal axis.

BACKGROUND OF THE INVENTION

In a so-called drum type (or a front loading type) spin extractor, wet laundry after being washed is loaded into a basket drum having a horizontal rotation axis from the front opening, and the drum is rotated about the horizontal axis at high speed. When, in the spin extractor of this type, the drum is rotated at high speed with the laundry distributed unevenly on the inner peripheral wall of the drum, abnormal vibration occurs due to the uneven mass distribution around the axis, causing an abnormal noise.

Several proposals have been made addressing this kind of abnormal vibration of the drum type spin extractors. In the Publication No. H6-254294 of Japanese Unexamined Patent Application, for example, a spin extractor is disclosed in which the laundry is evenly redistributed on the inner peripheral wall of the drum by rotating the drum at low speed before rotating it at high speed for extraction. The process in detail is as follows. First, the drum is rotated at a low speed for a very short time (at a speed corresponding to the centrifugal force of 1.2–1.5 G on the wall of the drum for about 5 seconds, for example). Next, the drum is rotated at another low speed which is a little higher than said low speed but much lower than the high speed for liquid extraction (at a speed corresponding to 2.3–2.6 G of the centrifugal force for 20 seconds, for example). The publication shows that the laundry in the drum is redistributed by such two-stage balancing operation. In addition, the spin extractor is provided with a vibration sensor on its base as a means for detecting the eccentric load due to an uneven distribution of the laundry in the drum. When the sensor detects vibration while the drum is rotated at the high speed for extraction, the speed of the drum is reduced.

In the above spin extractor, it is not assured that the laundry is redistributed evenly with a single cycle of the low-speed balancing operation. If vibration is detected by the sensor when the drum is rotated at the high speed for extraction, another trial of the low-speed balancing operation is necessary to redistribute the laundry. Since the difference between the low speed for balancing and the high speed for extraction is very large, it takes a considerable time to change the speed of the drum from one to the other. It takes a long time before a thoroughly even distribution is obtained if such trials are repeated several times.

Further, in the above spin extractor, the drum is rotated at a speed as high as the speed for extraction while detecting the eccentric load. So, when the eccentric load is very large, a motor for rotating the drum is overloaded while detecting the eccentric load, which may cause a breakdown of the motor.

For addressing the above problems, the inventors of the present application proposed a novel spin extractor disclosed in the Publication No. H09-290089 of Japanese Unexamined Patent Application. In this spin extractor, the laundry in the drum is redistributed by a balancing operation as follows. First, the drum is rotated at a speed where the centrifugal force acting on the laundry is a little greater than that of the gravity, so that the laundry is pressed on the inner peripheral wall of the drum and rotates with the drum. Under this condition, the eccentric load due to the uneven distribution of the drum is detected, where the eccentric load is detected based on the fluctuation in the motor current supplied to the drum motor. If the magnitude of the eccentric load is greater than a predetermined allowable value, the speed of the drum is rapidly reduced for a short time at a timing when the eccentric load is at the top of the drum, whereby part of the laundry falls onto the bottom because the centrifugal force decreases at the timing. By the balancing operation, the laundry in the drum is redistributed within a short time, so that the start of the high speed extraction is advanced.

The above spin extractor, however, may fail to suppress the abnormal vibration depending on the quality of the laundry loaded in the drum. Suppose, for example, that the laundry includes two types of articles: one type being such that liquid is hardly extracted, such as a blanket, and the other type being such that liquid is easily extracted, such as a shirt or a blouse (the two types of articles are respectively referred to as "hard-to-extract article" and "easy-to-extract article" hereinafter). In such a case, it is difficult to maintain a desirable load balance throughout the extraction even if the laundry is desirably distributed before the extraction, because the loading state considerably changes as the liquid is extracted from the laundry during the extraction.

SUMMARY OF THE INVENTION

For addressing the above problem, the present invention proposes a spin extractor whereby abnormal vibration or noise is suppressed assuredly during the high speed extraction even when the laundry includes various types of laundry articles.

Thus, the present invention proposes a first spin extractor for extracting liquid from the wet laundry by rotating a basket drum with the laundry contained therein at high speed about a horizontal axis, which includes:

a) a position detector for detecting the position of an eccentric load due to an uneven distribution of the laundry while the laundry is pressed on the inner peripheral wall of the drum by centrifugal force and rotates with the drum;

b) an operation controller for detecting a first position of the eccentric load with the position detector when the drum is rotated at a speed where the extraction of liquid from the laundry is hardly caused by centrifugal force, then raising the speed of the drum so that a portion of the liquid retained in the laundry is extracted by centrifugal force, and detecting a second position of the eccentric load with the position detector after the speed is raised; and c) a quality determiner for determining the uniformity in the extraction quality of laundry articles constituting the laundry in the drum by comparing the first position and the second position.

In the first spin extractor, it is determined before rotating the drum at a high speed for extraction whether the uniformity in the extraction quality of laundry articles constituting the laundry in the drum is adequately high. Here, the extraction quality of a laundry article is a parameter representing the ease of extracting liquid. The extraction quality is determined as follows.

First, the operation controller controls the speed of the drum so that the laundry is slightly pressed on the inner peripheral wall of the drum by centrifugal force and rotates with the drum without causing the extraction of liquid from the laundry. That is, the drum is rotated at a speed where the centrifugal force acting on the laundry is a little greater than that of gravity. During this rotation, the position detector detects the position of the eccentric load due to the uneven distribution of the laundry, and the position is defined as the first position. Next, the operation controller raises the speed of the drum to carry out a weak extraction whereby a portion of the liquid retained in the laundry is extracted by centrifugal force. After the weak extraction, the position of the eccentric load is detected again, which is defined as the second position.

By the weak extraction, more liquid is extracted from easy-to-extract articles, whereas less liquid is extracted from hard-to-extract articles. Thus, when the uniformity in the extraction quality of the laundry articles loaded in the drum is low, the position of the eccentric load changes because the weights of the laundry articles decrease unevenly according to the difference in extraction quality. When, on the other hand, the uniformity of the laundry articles loaded in the drum is high, the position of the eccentric load changes little because the weights of the laundry articles decrease evenly. Hence, the quality determiner determines, or estimates, the uniformity in the extraction qualities of the laundry articles based on the difference between the first position and the second position.

The determination result is utilized in the operation as described below, for example. That is, when the uniformity in the extraction quality of the laundry articles in the drum is high, the probability of the eccentric load's increasing during the high speed extraction is very small. When, on the other hand, the uniformity in the extraction quality of the laundry articles is low, it is probable that the eccentric load increases because the extraction of liquid proceeds unevenly during the high speed extraction. Therefore, when the uniformity in the extraction quality is low, the speed for carrying out the extraction is set lower than when the uniformity is high. As a result, the maximum allowable level of the eccentric load (i.e. the magnitude of the eccentric load causing a maximum allowable vibration) becomes higher, so that the abnormal vibration does not occur even when the eccentric load increases as the extraction proceeds.

When the first position of the eccentric load is being detected in the first spin extractor, it is necessary that each laundry article retains as much liquid as possible. In the detecting process, however, the liquid is gradually extracted from the laundry while the laundry is pressed on the inner peripheral wall of the drum and rotates with the drum, even though the speed of the drum is low. Therefore, in a preferable mode of the first spin extractor, the operation controller is constituted so that the first position is detected under the condition that a preset amount of liquid is present in the bottom of the drum. By this constitution, every laundry article pressed on the inner peripheral wall of the drum contacts and absorbs the liquid when it comes to the bottom of the drum in each rotation. Thus, all the laundry articles on the inner peripheral wall of the drum constantly retains an adequate amount of the liquid, irrespective of the position on the wall.

In a washing/drying machine which carries out an extraction subsequent to a washing or rinsing of the laundry, part of the liquid used for washing or rinsing remains in the bottom of the drum just after the washing or rinsing. So, when the first spin extractor is used as a part of a washing/drying machine, it is preferable to constitute the operation controller to drain the liquid used for washing and rinsing so that a preset amount of the liquid remains in the bottom of the drum, and the first position of the eccentric load is detected with the liquid remaining there. By this constitution, not only an additional step of supplying liquid for detecting the first position is not required, but also the efficiency of utilizing the liquid is enhanced.

For the weak extraction in the first spin extractor, it is necessary to rotate the drum at a considerably high speed, though not as high as the high speed for extraction, for the weak extraction. So, there is a possibility that an abnormal vibration occurs due to an abnormally large eccentric load. Besides, it is of course preferable to correct the balance of the laundry before detecting the change in the position of the eccentric load for preventing the abnormal vibration more assuredly during the extraction. Therefore, in another preferable mode of the first spin extractor, the operation controller is constituted so that a balancing operation is carried out for redistributing the laundry evenly on the inner peripheral wall of the drum before detecting the first position of the eccentric load.

The balancing operation may preferably include a step of reducing the speed of the drum for a short time at a timing when the eccentric load is at the top of the drum. By this method, laundry articles stacked closer to the axis of the drum fall at this timing because the centrifugal force decreases due to the speed reduction, and the centrifugal force acting on the articles closer to the drum axis becomes smaller than that of gravity.

It is still preferable to perform the balancing operation with a liquid present in the bottom of the drum. The reason is as follows. When a laundry article retains a liquid, the laundry article has a smaller volume than when it is dry. So, by the above-described method, it is easier to clear and retain an open space around the drum axis when the laundry includes a large laundry article such as bedclothes or Japanese Futon, or when the total amount of the laundry is large, so that the laundry articles fall more easily.

In another preferable mode of the first spin extractor, the position detector is constituted so that the position of the eccentric load is detected based on a torque component in a motor current supplied to a motor for rotating the drum. When the speed of a motor is relatively low, the torque component in the motor current can be used as an index that correctly corresponds to the fluctuation in the load torque due to the eccentric load. Therefore, the position of the eccentric load on the inner peripheral wall of the drum is detected based on the fluctuation in the torque component. When the distance between the first and second positions is larger than predetermined, it is concluded that the laundry articles in the laundry have a diversity of extraction qualities.

As described above, in the first spin extractor, the possibility of the eccentric load's increasing during the high speed extraction is estimated before the start of the extraction by determining the uniformity in extraction quality of laundry articles. That is, when the laundry in the drum includes hard-to-extract articles and easy-to-extract articles, the abnormal vibration or noise is prevented assuredly by, for example, performing the extraction at a relatively low speed where the vibration does not occur. When, on the other hand, the laundry articles in the drum have a uniform extraction quality, the extraction is performed at a high speed, so that the extraction is effectively completed within a short time.

In addition to the first spin extractor, the present invention further proposes a second spin extractor for extracting liquid from the wet laundry by rotating a basket drum with the laundry contained therein at high speed about a horizontal axis, which includes:

a) a motor for rotating the drum;

b) a current detector for detecting the motor current supplied to the motor; and c) an eccentric load determiner for determining an increase in the eccentric load due to an unbalanced mass distribution of the laundry by checking an increase in the motor current detected by the current detector when the drum is rotated at a high speed for the extraction of the laundry.

In the first spin extractor, the process of preventing abnormal vibration is carried out based on an estimation as to whether the eccentric load will increase, where the estimation is obtained by determining the uniformity in the extraction qualities of laundry articles before starting the high speed extraction. In the second spin extractor, on the other hand, the process of preventing abnormal vibration is carried out when an increase in the motor current is detected after starting the high speed extraction. When the speed of the drum is raised to a high speed for extraction, it is difficult to detect the eccentric load correctly by utilizing the torque component in the motor current as described above. In the second spin extractor, therefore, the eccentric load is detected by utilizing the motor current itself supplied to the motor.

For raising the speed of the motor from a first speed to a second speed which is higher than the first speed, it is necessary to increase the motor current corresponding to the increase in the speed. When the eccentric load increases due to the extraction of liquid from the laundry in the process of raising the speed, it is necessary to supply more motor current than when there is no increase in the eccentric load in order to attain the second speed. Thus, the eccentric load determiner checks the increase in the motor current, and determines that the eccentric load has increased in the process of the extraction when the increase in the motor current is greater than a preset value.

When the eccentric load increases in the course of the extraction, it is possible that the increase may cause a vibration having a greater magnitude than estimated before the high speed extraction. So, when the increase in the eccentric load is detected, a process for preventing the vibration is carried out.

Thus, in a preferable mode, the second spin extractor has an operation controller for setting the maximum speed of the drum lower when it is determined by the eccentric load determiner that the increase in the eccentric load is greater than a preset value, than when it is determined that the increase in the eccentric load is smaller than the preset value.

In the above-described spin extractor, when the increase in the eccentric load is found to be greater than the preset value in the course of raising the speed of the drum from the first speed to the second speed, the acceleration is stopped and, during the extraction, the drum is rotated at a speed that is lower than a maximum speed predetermined for the extraction. When, on the other hand, the increase in the eccentric load is found to be smaller than the preset value, the drum is rotated at the maximum speed.

As described above, in the second spin extractor, the increase in the eccentric load is monitored also after the high speed extraction is started. So, when the mass distribution in the drum becomes unbalanced during the extraction because the laundry includes hard-to-extract articles and easy-to-extract articles, the change in the mass distribution is detected immediately, and the abnormal vibration is prevented by reducing the speed of the drum, for example.

In addition, it is highly recommendable to incorporate the second spin extractor into the first spin extractor to obtain a spin extractor whereby the abnormal vibration or noise is suppressed more assuredly.

DETAILED DESCRIPTION OF A PREFERRED EMBODIMENT

Figure 1:
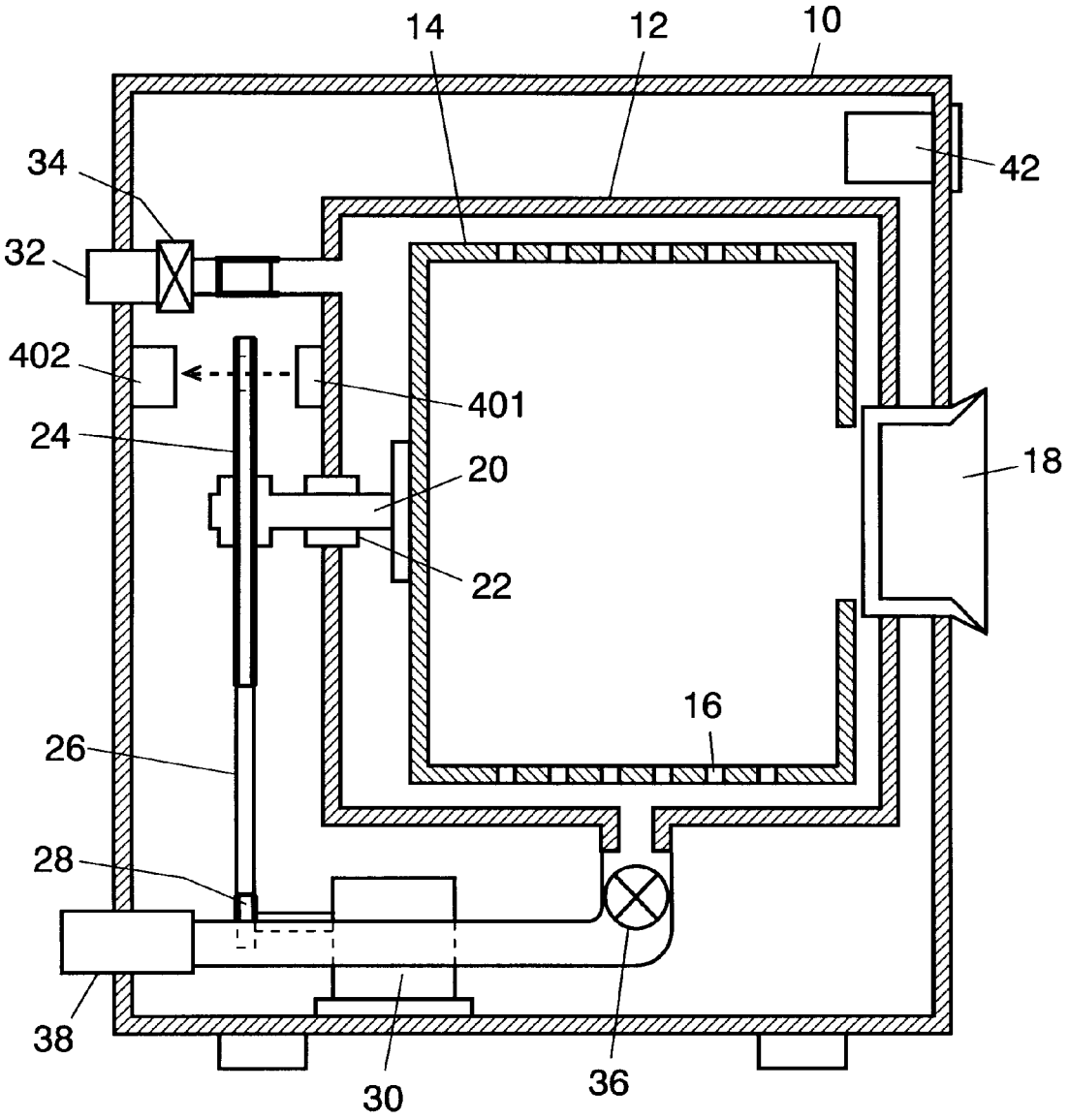
FIG. 1 is a vertical sectional view of a drum type washing machine including a spin extractor embodying the present invention, viewed from one side.

A washing machine embodying the first and second invention described above is described referring to FIGS. 1 and 2. As shown in FIG. 1, an outer tub 12 is provided in a housing 10 of the washing machine, and a drum 14 is provided in the outer tub 12, where the drum is supported by a main shaft 20 at its center. A door 18 is provided at the open front end of the drum 14 from which laundry articles are thrown into the drum 14. Perforations are formed in the peripheral wall of the drum 14 through which water supplied into the outer tub 12 comes in the drum 14 and water extracted from the laundry in a high-speed spin extracting operation is drained to the outer tub 12.

The main shaft 20 is held by a bearing 22 fixed in the outer tub 12, and a main pulley 24 is fixed at the other end of the main shaft 20. A motor 30 is settled under the outer tub 12, and a motor pulley 28 is fixed at an end of its motor shaft. A V-belt 26 connects the motor pulley 28 and the main pulley 24 whereby the drum 14 is driven by the motor 30. Water for washing or water for rinsing is supplied to the outer tub 12 through a water inlet 32 which is controlled by a water supply valve 34. Water after washing or water after rinsing is drained through a water outlet 38 which is controlled by a drainage valve 36. In an upper end of the housing 10 is provided a control box 42 containing electrical circuits for controlling the washing machine.

A light emitter 401 fixed on the outer face of the rear end panel of the outer tub 12 and a light receiver 402 fixed on the inner face of the rear end panel of the housing 10 facing each other across the main pulley 24 constitute a rotation sensor. While the rim of the main pulley 24 normally blocks the light path of the rotation sensor, a hole formed in the rim allows the light pass through once in every rotation of the drum 14, which generates a rotation signal or a rotation marker of the drum 14.

Figure 2:
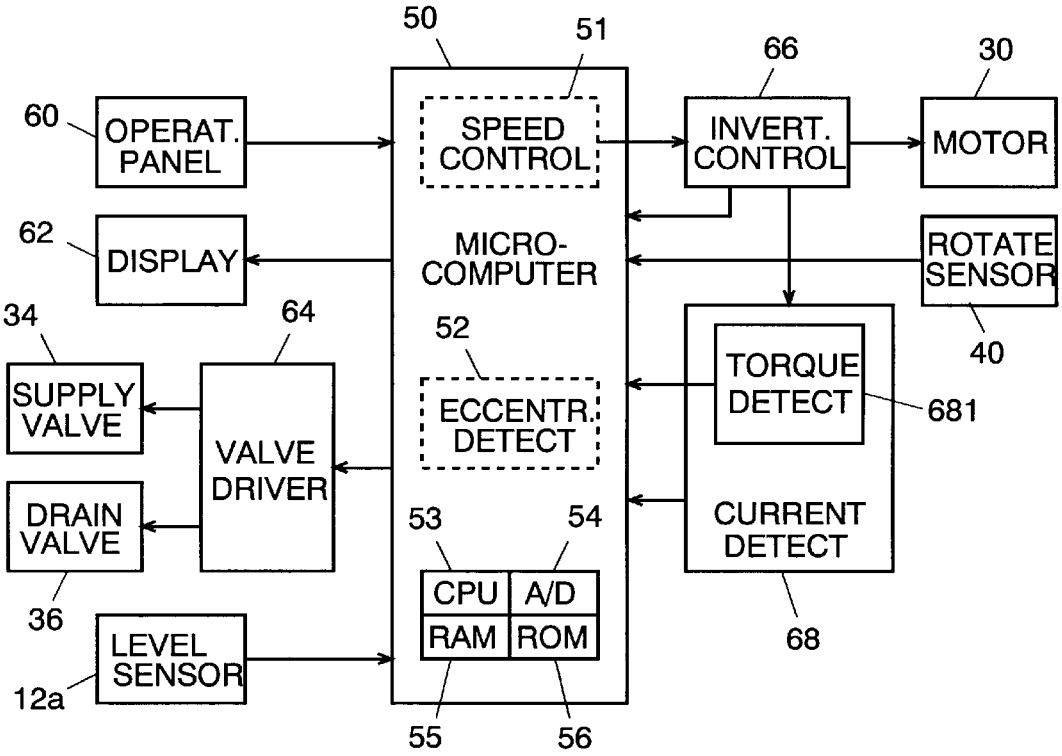
FIG. 2 is a block diagram showing the electrical system of the washing machine.

The electrical system of the washing machine is illustrated in FIG. 2. The whole system is controlled by a micro-computer 50 which includes a CPU 53, A/D converter 54, RAM 55, ROM 56 and other peripheral devices. In the ROM 56 is stored programs for automatically operating the washing machine such as for washing, for rinsing, for extracting, etc. beforehand. The micro-computer 50 is connected to an operation panel 60, a display 62, a valve driver 64, an inverter controller 66, a motor current detector 68, etc.

The micro-computer 50 functionally includes a speed controller 51 and an eccentricity detector 52. The speed controller 51 controls the speed of the motor 30 by sending a speed control signal to an inverter controller 66, whereby the drum 14 is rotated at a desired speed which is reduced from that of the motor 30 with a certain preset ratio. The motor current detector 68 measures the electric current supplied to the motor 30, and a torque component detector 681 of the motor current detector 68 extracts a component from the motor current relating to the torque of the motor.

Figure 3:
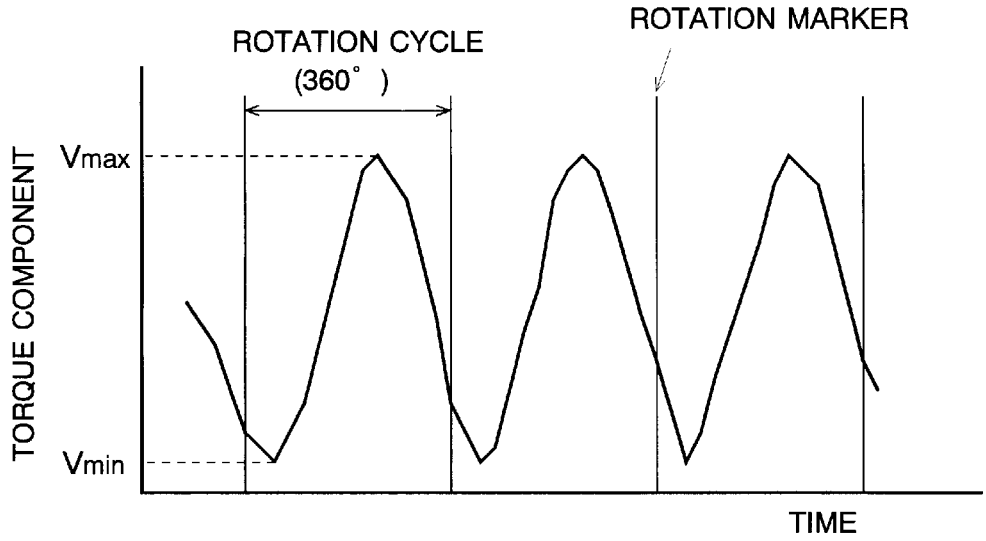
FIG. 3 is a graph showing an example of the oscillation of the torque component of the motor current.

When the laundry is distributed unevenly in the drum 14, the load torque for rotating the drum 14 oscillates in one rotation, and the torque component of the motor current oscillates according to the oscillation of the load torque. FIG. 3 shows an example of the oscillation of the torque component of the motor current represented by a voltage change. The rotation markers in FIG. 3 are provided by the rotation sensor 40 and indicate every rotation of the drum 14. The maximum peaks Vmax in the torque component represent the position of the maximum load torque in a rotation of the drum 14. The load torque increases while the drum 14 is lifting the laundry making the eccentric load against the gravity, and its maximum peak Vmax appears when the eccentric load comes within the angle of 90° before the highest point of the drum 14. Thus the position of the eccentric load in the drum 14 is represented by the position of the maximum peak Vmax and can be denoted by an angle (from 0° to 360°) from the rotation marker.

The amplitude of the torque component Vmax−Vmin represents the magnitude of the eccentric load. Thus the relationship between the magnitude of the eccentric load in the drum and the amplitude of the torque component in the motor current is examined and is stored in the ROM 56 beforehand. When the eccentricity detector 52 receives a signal as shown in FIG. 3 from the torque component detector 681 when an extracting operation is underway, the eccentricity detector 52 detects the maximum Vmax and the minimum Vmin of the signal, calculates the amplitude Vmax−Vmin, and determines the magnitude of the eccentric load referring the relationship stored in the ROM 56.

Figure 4:
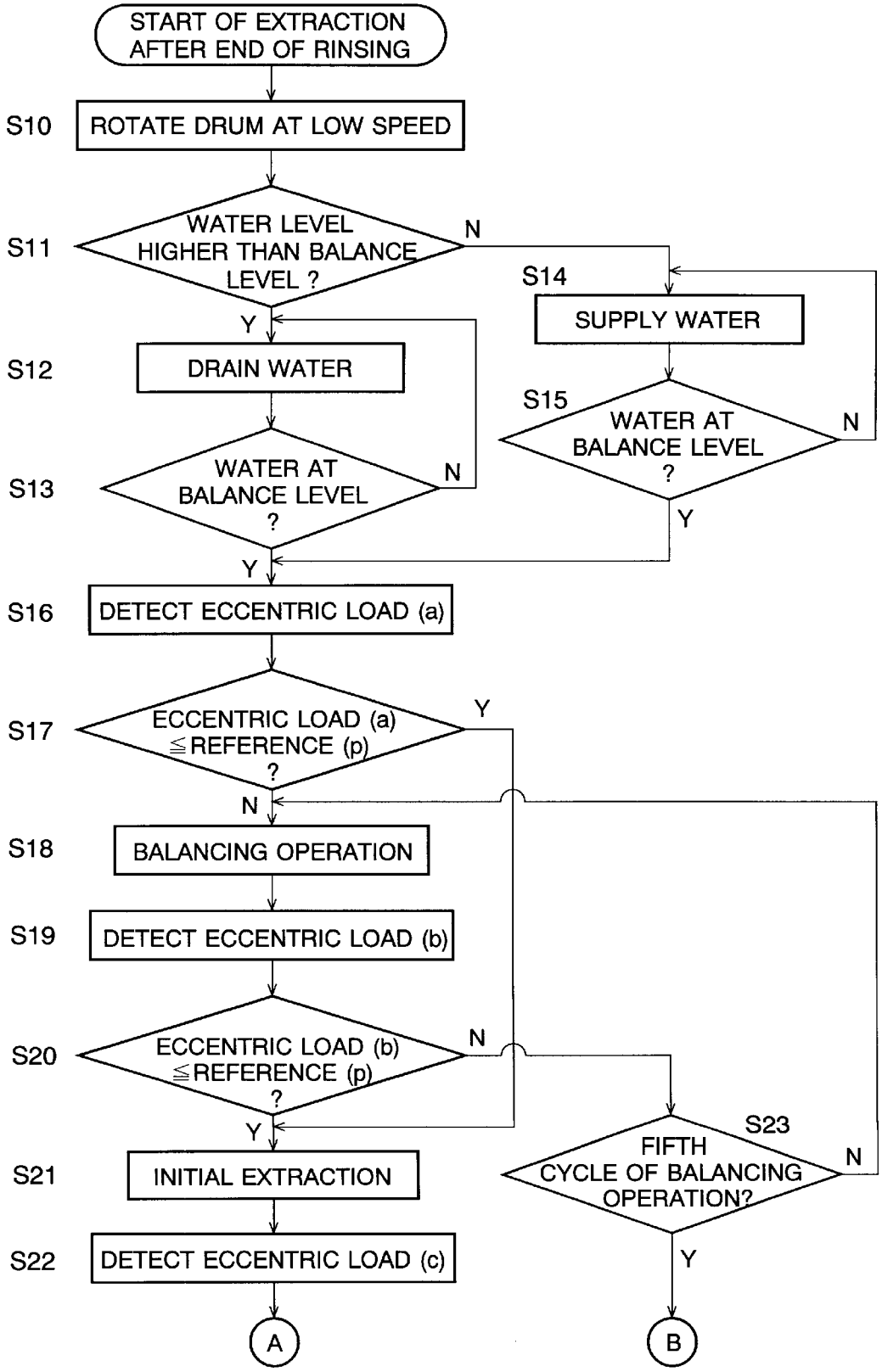
FIGS. 4 and 5 are flow charts showing the control steps during the extracting operation by the spin extractor.
Figure 5:
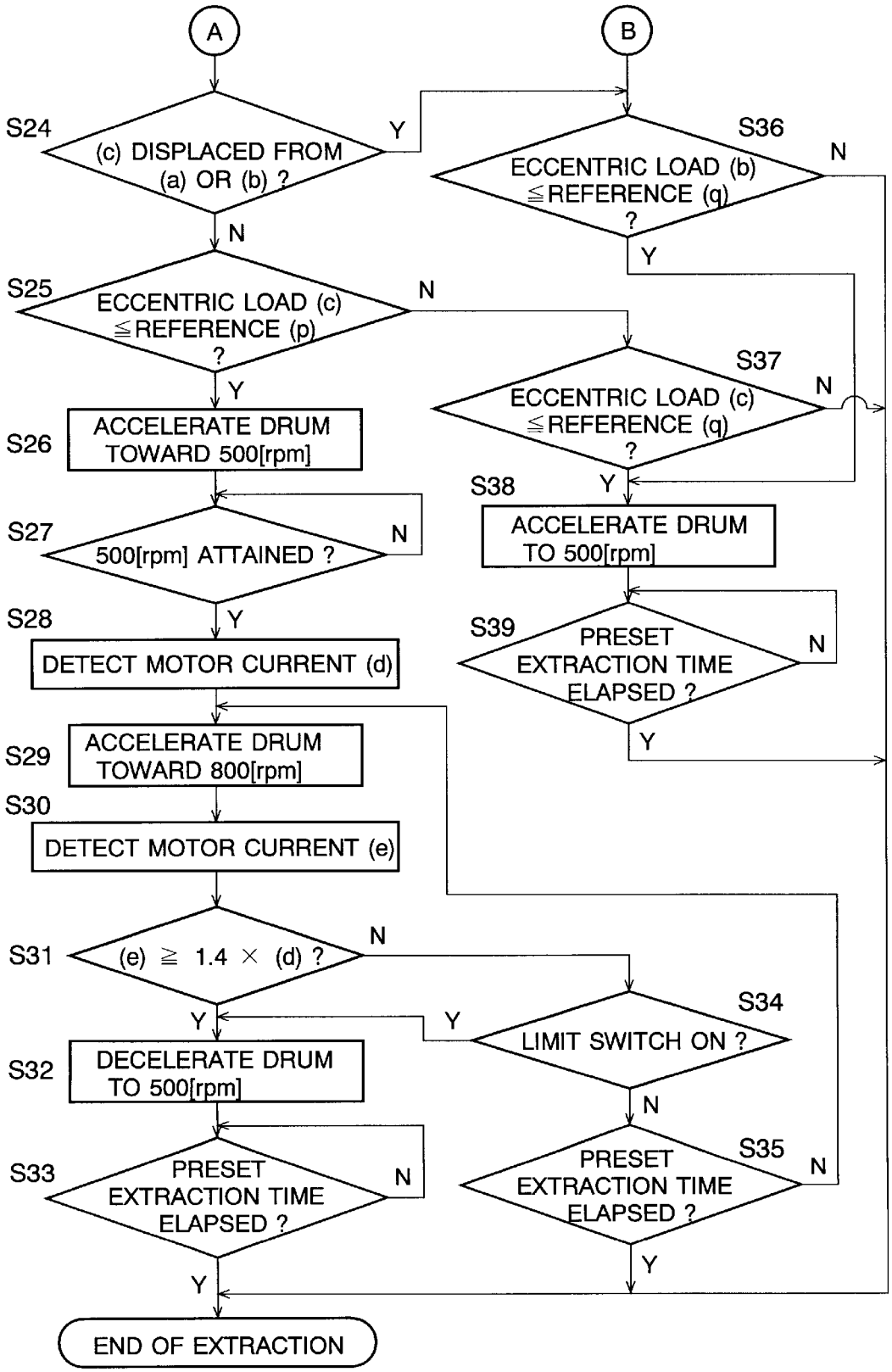

The operation of the washing machine controlled by the micro-computer 50 in the extracting operation is described referring the flow charts of FIGS. 4 and 5.

When an extracting operation begins after washing and rinsing, the speed controller 51 sends an appropriate speed control signal to the inverter controller 66 so that the drum 14 is rotated in one direction at a low speed that is set a little higher than the speed ("critical speed") at which the centrifugal force acting on the laundry is equal to that of gravity (step S10). The speed is determined according to the diameter of the drum. When the diameter of the drum 14 is 610 mm, for example, the speed is 100[rpm]. When the drum 14 attains the speed (100[rpm]), the laundry articles are slightly pressed on the inner wall of the drum 14 by centrifugal force and rotate with the drum 14.

Then the level of the water in the outer tub 12 is detected by a level sensor 12*a* attached to the outer tub 12, and determined whether it is higher than a preset balance level (step S11). It is preferable to preset the balance level so that there is a small amount of water present in the bottom of the drum 14 because of the reason described later. For example, the balance level is set at one or two parts in the total ten equal divisions from the bottom to the center of the outer tub 12.

Since the water level is normally higher than three parts in the ten divisions in the washing and rinsing operations of the washing machine, the level is higher than the balance level when the extracting operation begins. In such case, the micro-computer 50 sends a control signal to the valve driver 64 to drain the water through the drainage valve 36 (step S12) until the water level in the outer tub 12 reaches the balance level, when the drainage valve 36 is closed (step S13 to S16). When, on the other hand, the detected water level is lower than the balance level at step S11, the water supply valve 34 is opened to raise the level (step S14) until the level attains the balance level, when the water supply valve 34 is closed (step S15 to S16). At this balance level of the water, the laundry, wherever the laundry articles exist, pressed on the peripheral wall and moving with the drum 14 is dipped into and absorbs water when it comes to the bottom of the drum 14.

Thus it is preferable to set the balance level at the position a little higher than the bottom of the drum 14 in order to let every laundry article assuredly absorb water while the drum 14 rotates. If the balance level is set too high, the water works as a resistance to the rotation of the drum 14, which deteriorates the accuracy of the eccentric load detection. It is therefore important to set the balance level at an appropriate value to let the laundry absorb enough water while maintaining the accuracy of the eccentric load detection.

The eccentricity detector 52 determines the magnitude of the eccentric load based on the torque component of the motor current detected by the torque component detector 681 (step S16). The magnitude (a) of the eccentric load is compared with a reference value (p) at step S17. The reference value (p) is predetermined regarding the maximum allowable vibration (amplitude), or parameters of similar kind, that occurs during subsequent high-speed extracting operation, which will be discussed in detail later. For example, the reference value (p) is predetermined at 0.7 kg if the magnitude of the vibration is less than a preset value during the high-speed extracting operation at the drum speed of 800[rpm] with a 0.7 kg eccentricity present in the drum 14.

If the magnitude (a) of the eccentric load is greater than the reference value (p) at step S17, a balancing operation is started (step S18) as follows. If, on the other hand, the magnitude (a) of the eccentric load is less than the reference value (p) at step S17, the following balancing operation at steps S18 and S19 is passed by.

In step S18, the speed controller 51 sets the drum speed at such a speed that the laundry in the drum 14 is slightly pressed onto the inner peripheral wall and moves with the drum 14 due to the centrifugal force. Monitoring changes in the torque component of the motor current as shown in FIG. 3, the speed controller 51 decelerates the drum 14 briefly at a position displaced from the position of the maximum peak Vmax by a preset angle before the position of Vmax in the motor current. The decelerated speed is set at such a value that the gravity on the laundry is a little greater than the centrifugal force. By such a sudden deceleration at such a position, the laundry articles clinging to the inner peripheral wall of the drum 14 and rising toward the top fall in the drum 14. Since the magnitude of the centrifugal force acting on a rotating laundry article varies depending on its remoteness from the rotating center, it is possible by appropriately setting the decelerated speed to make only articles nearer to the center fall while articles closer to the peripheral wall remain pressed thereon. Such a speed or other parameters (speeds before and after the deceleration, decelerating time, etc.) for realizing such a situation can be determined by previous experiments.

After the laundry articles are redistributed in the drum 14 by the balancing operation as described above, the drum speed is raised, to 100[rpm] in the above case, and the eccentric load of the drum 14 is measured (step S19). The measured value (b) of the eccentric load is again compared with the reference value (p) (step S20). If the eccentric load (b) is not less than the reference value (p), it is then determined whether the balancing operation of step S18 has been repeated five times (step S23). If the repetition is less than five, the balancing operation of step S18 is executed again to redistribute the laundry articles in the drum 14. When the balancing operation is repeated five times without success, the process proceeds to step S36 (FIG. 5).

If the eccentric load (a) is less than the reference value (p) at step S17 or the corrected eccentric load (b) is less than the value (p) at step S20, the water in the outer tub 12 is drained and an initial extraction is performed at step S21. Specifically, the micro-computer 50 sends a signal to the valve driver 64 to open the drainage valve 36, and the speed controller 51 sends a speed signal to the inverter controller 66 to rotate the drum 14 at a preset intermediate speed Rm. The intermediate speed Rm is preset so that laundry in the drum 14 is pressed but not so strongly on the inner peripheral wall and the water absorbed in the laundry is partly extracted. The intermediate speed Rm and its duration in step S21 is about 200[rpm] and 30 seconds, for example.

After the initial extraction at step S21, the drum speed is lowered, 100[rpm] for example, and an eccentric load detection is performed (step S22). Then the position of the eccentric load (c) in the drum 14 detected here is compared with those of the eccentric loads (a) and (b) detected at steps S16 and S19, and the change in the position (or displacement of the eccentric load in the drum 14) is compared with a preset reference value (step S24, FIG. 5).

Figures 6A, 6B, 6C, 6D:
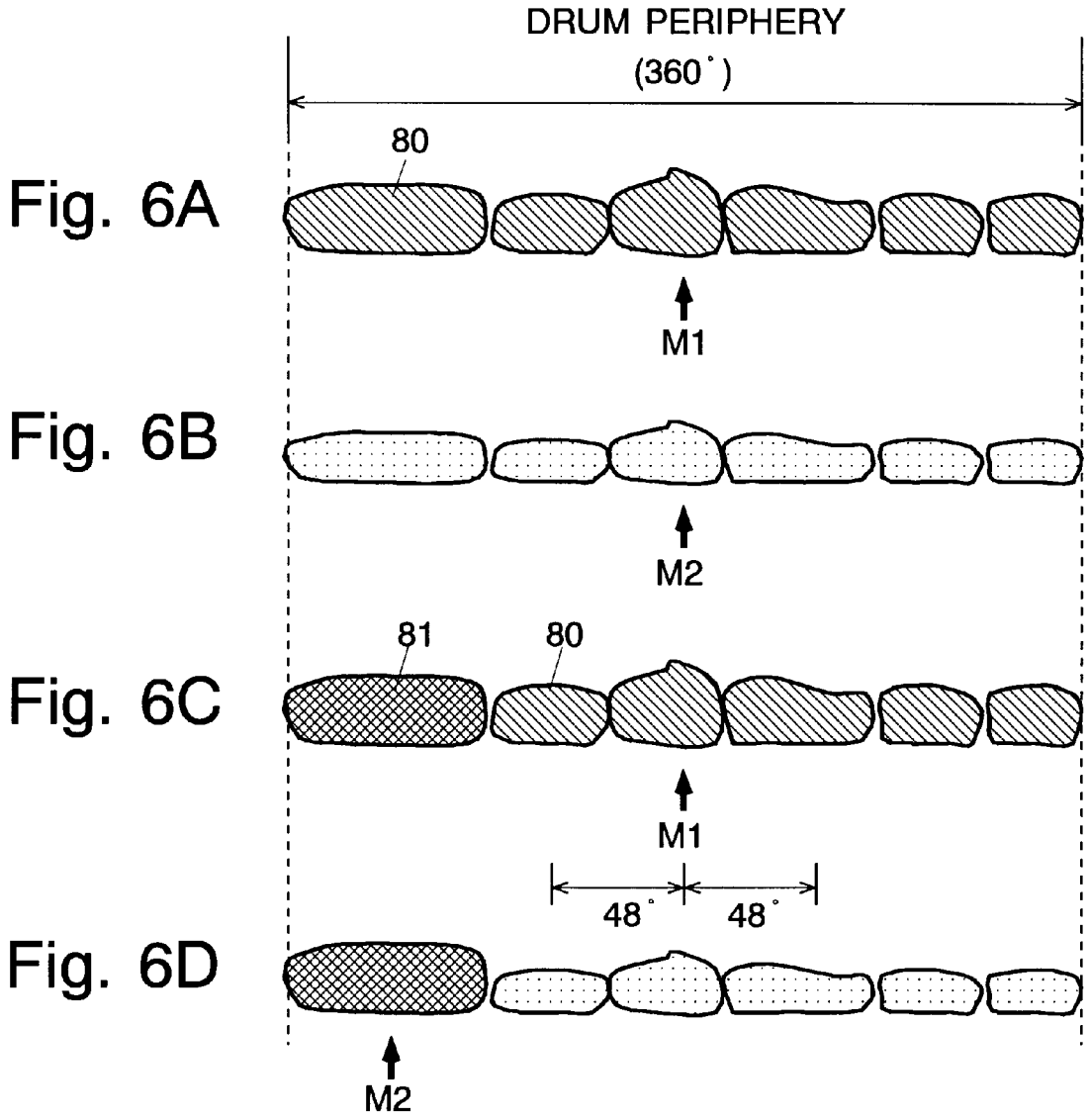
FIGS. 6A–6D are illustrations showing distribution of laundry articles on the inner peripheral wall of the drum.

FIG. 6 illustrates the distribution of laundry articles on the inner peripheral wall of the drum 14. The entire width of FIGS. 6A–6D denotes the periphery of the inner wall of the drum 14. FIG. 6A shows such a case where laundry articles 80 of the same type are distribute on the inner peripheral wall of the drum 14 and an eccentric load M1 exists at the arrowed position. Since, in this case, the weight of the laundry articles 80 decreases uniformly by the initial extraction at step S21, the position of the eccentric load is unchanged while the magnitude of the eccentric load decreases to M2 as shown in FIG. 6B.

If, on the other hand, the laundry includes articles of different extraction qualities, i.e., easy-to-extract articles 80 (such as shirts) and hard-to-extract articles 81 (such as blankets), as shown in FIG. 6C, the weight of the articles 80 decreases much while that of the articles 81 decreases less. This results in a development of a new eccentricity and change in the position of the eccentric load as shown in FIG. 6D, as well as its magnitude M2. Thus, it can be deduced from a large change in the position of the eccentric load that the laundry includes a variety of articles differing in extraction quality, and, on the contrary, a small or no change in the position of the eccentric load indicates uniformity (or similarity) in the extraction quality of laundry articles in the drum 14.

As shown in FIG. 6C, a range of ±48° is set at both sides of the position of the eccentric load (a) or (b) (which is represented by the maximum peak Vmax in the torque component), and the position of the eccentric load (c) (i.e., the position of the maximum peak Vmax in the torque component) is compared with the range at step S24.

If the displacement of the eccentric load is within the preset range, the magnitude of the eccentric load (c) is then compared with the reference value (p) (step S25). If the magnitude of the eccentric load (c) is less than the reference value (p), the speed controller 51 accelerates the drum 14 up to 500[rpm], for example (step S26). When the drum speed attains the value (step S27), the motor current (d) is measured by the motor current detector 68 and the value is stored in the RAM 55 (step S28). Then the speed controller 51 accelerates the speed of the drum 14 toward 800[rpm], for example (step S29), and the motor current is continuously measured for 30 seconds by the motor current detector 68. The maximum value in the measured motor current measured this time is set as the motor current (e) (step S30). Then it is determined at step S31 whether the motor current (e) is greater than 1.4 times the motor current (d) read out from the RAM 55.

At such high speed, the torque component cannot follow the oscillation in the load torque of the drum caused by the eccentric load, and it is improper to use the torque component for detecting the eccentric load. Meanwhile, the motor current changes according to the speed of the motor (or the speed of the drum 14) which is controlled by the speed signals given by the speed controller 51 to the inverter controller 66. It is revealed from our experiments that the magnitude of the motor current depends on the eccentricity of the drum in such a high speed region. Thus, if the motor current increases more than expected for the case of no increase in the eccentric load while the drum is accelerated from 500[rpm] to 800[rpm], it is assumed that the eccentric load has increased in the initial extraction.

The multiplying factor 1.4 used in step S31 is determined through experiments regarding the above reason. That is, the increase in the motor current while the drum speed is accelerated from 500[rpm] to 800[rpm] is normally less than 40%. If the motor current (e) measured while accelerating is greater than 1.4 times the motor current (d) measured at 500[rpm] at step S31, it is expected that the eccentric load may further increase and an abnormal vibration may occur when the laundry in the drum 14 is further extracted at speeds higher than 500[rpm]. Thus the motor speed is lowered to 500[rpm] at step S32, and the extracting operation is executed at this speed for a preset period of time (step S33).

If the motor current (e) is less than 1.4 times the motor current (d) at 500[rpm] at step S31, the state of a limit switch for detecting the vibration of the washing machine is checked (step S34). The limit switch turns on when the vibration of the washing machine is greater than a preset amount. If the limit switch is not turned on, another reference time period for continuing the extracting operation is checked (step S35). If the reference time period is not elapsed at step S35, the process returns to step S29 to continue accelerating the drum speed. If the limit switch turns on while the drum is accelerated at step S34, i.e., the vibration of the washing machine becomes greater than the preset value, the drum speed is reduced to 500[rpm] (step S32), and the extracting operation is executed at this speed for the preset time period (step S33).

If the balancing operation is repeated for five cycles (step S23, FIG. 4) or if the displacement of the eccentric load (c) is out of the preset range (step S24), it is determined whether the magnitude of the eccentric load (b) is less than a second reference value (q) (step S36). If the magnitude of the eccentric load (c) is greater than the first reference value (p) (step S25), it is then determined whether the eccentric load (c) is less than the second reference value (q) (step S37). The second reference value (q) is predetermined as follows. If the drum has an eccentric load equal to (q) (which is greater than (p)), the same vibration of the washing machine occurs at speeds lower than the speed (800[rpm] in this case) at which the eccentric load (p) causes the same vibration. The second reference value (q) is set at 1500 grams, for example. If the measured eccentric load (a), (b) or (c) is less than the second reference value (q), the drum is accelerated toward 500[rpm] (step S38) and the extracting operation is carried out at this speed for a preset time period (step S39).

If the measured eccentric load (a), (b) or (c) is greater than the second reference value (q), the extracting operation is stopped here because the vibration at 500[rpm] is expected to exceed the preset allowable value.

It should be noted herewith that the above embodiment is a mere example, and the present invention can be modified in various ways within the scope thereof. For example, the values of the parameters in the above embodiment may have other values depending on the case. Further, it is obvious that the inventive spin extractor can be used not only for extracting water from the laundry as described above, but also for extracting other liquid material, such as dry cleaning agent.

What is claimed is:

1. A spin extractor for extracting liquid from wet laundry by rotating a basket drum with the laundry contained therein at high speed about a horizontal axis, comprising:

a) a position detector for detecting a position of an eccentric load due to an uneven distribution of the laundry while the laundry is pressed on an inner peripheral wall of the drum by centrifugal force and rotates with the drum;

b) an operation controller for detecting a first position of the eccentric load with the position detector when the drum is rotated at a speed where extraction of liquid from the laundry is hardly caused by centrifugal force, then raising the speed of the drum so that a portion of the liquid retained in the laundry is extracted by centrifugal force, and detecting a second position of the eccentric load with the position detector after the speed is raised; and c) a quality determiner for determining a uniformity in an extraction quality of laundry articles constituting the laundry in the drum by comparing the first position and the second position.

2. The spin extractor according to claim 1, wherein the drum is rotated at a speed where the centrifugal force acting on the laundry is little greater than that of gravity when the operation controller detects the first position of the eccentric load with the position detector.

3. The spin extractor according to claim 1, wherein the operation controller detects the first position of the eccentric load with the position detector while rotating the drum with a preset amount of liquid present in the bottom of the drum.

4. The spin extractor according to claim 2, wherein the operation controller detects the first position of the eccentric load with the position detector while rotating the drum with a preset amount of liquid present in the bottom of the drum.

5. The spin extractor for extracting liquid from wet laundry subsequent to washing or rinsing of the laundry according to claim 3, wherein the operation controller detects the first position of the eccentric load after draining the liquid used for the washing or rinsing so that the preset amount of the liquid remains in the bottom of the drum.

6. The spin extractor for extracting liquid from wet laundry subsequent to washing or rinsing of the laundry according to claim 4, wherein the operation controller detects the first position of the eccentric load after draining the liquid used for the washing or rinsing so that the preset amount of the liquid remains in the bottom of the drum.

7. The spin extractor according to claim 1, wherein the operation controller controls the rotation of the drum to perform a balancing operation for redistributing the laundry evenly on the inner peripheral wall of the drum before detecting the first position of the eccentric load.

8. The spin extractor according to claim 7, wherein the balancing operation comprises a step of reducing the speed of the drum for a short time at a timing when the eccentric load is at the top of the drum.

9. The spin extractor according to claim 1, wherein a rotational controller, conducts the extraction so that the drum is rotated at a lower speed when it is determined by the quality determiner that the uniformity in the extraction qualities of the laundry is low, compared to that when it is determined that the uniformity is high.

10. The spin extractor according to claim 1, wherein the position detector detects the position of the eccentric load based on a torque component in a motor current supplied to a motor for rotating the drum.

11. A spin extractor for extracting liquid from wet laundry by rotating a basket drum with the laundry contained therein at high speed about a horizontal axis, comprising:

a) a motor for rotating the drum;

b) a current detector for detecting the motor current supplied to the motor; and c) an eccentric load determiner for determining an increase in the eccentric load due to an unbalanced mass distribution of the laundry by checking an increase in the motor current detected by the current detector when the drum is rotated at a high speed for the extraction of the laundry.

12. The spin extractor according to claim 11, further comprising an operation controller for setting a maximum speed of the drum lower than when it is determined by the eccentric load determiner that the increase in the eccentric load is greater than a preset value, than when it is determined that the increase in the eccentric load is smaller than the preset value.

* * * * *